United States Patent [19]

Chatani et al.

[11] 4,306,373

[45] Dec. 22, 1981

[54] INTERCONNECTING TOY BLOCK ARRANGEMENT

[75] Inventors: Yasushi Chatani, Tokorozawa; Toshio Tsuchikura, Koshigaya, both of Japan

[73] Assignee: Kawada Co. Ltd., Tokyo, Japan

[21] Appl. No.: 64,523

[22] Filed: Aug. 7, 1979

[30] Foreign Application Priority Data

Sep. 4, 1978 [JP] Japan ..... 53-120543[U]

[51] Int. Cl.[3] ..... A63H 33/10

[52] U.S. Cl. ..... 46/25; 46/26

[58] Field of Search ..... 46/17, 16, 23, 24, 25, 46/26, 28, 30, 31, 29; 35/18 A

[56] References Cited

U.S. PATENT DOCUMENTS

| | | | |
|---|---|---|---|
| 1,779,826 | 10/1930 | Potter | 46/28 |
| 1,985,032 | 12/1934 | Hoult | 46/29 |
| 2,921,347 | 1/1960 | Solomon | 46/17 X |
| 3,069,805 | 12/1962 | Burrows | 46/17 X |
| 3,604,130 | 9/1971 | Forrstrom | 35/18 A |
| 3,651,597 | 3/1972 | Daenen | 46/25 |
| 3,681,870 | 8/1972 | Alpert | 46/26 |
| 3,706,139 | 12/1972 | Brumlik | 35/18 A |
| 4,037,978 | 7/1977 | Connelly | 35/18 A X |
| 4,106,657 | 8/1978 | Dogliotti | 46/23 X |

*Primary Examiner*—F. Barry Shay

*Attorney, Agent, or Firm*—Finkelstein, McGuire and Thut

[57] ABSTRACT

An improved frictional interconnecting toy block arrangement having a hollow body means fabricated of a semi-flexible material such as a blowmolded plastic. The interconnecting of the toy blocks with each other is achieved by female coupler means and male couplers. The male couplers are part of the body means and unitarily fabricated of blowmolded plastic during the fabrication of the body means. The female coupler means are fabricated of a more rigid plastic such as an injection molded plastic which can be fabricated to close tolerances. The female coupler means fits and is retained within apertures molded into the walls of the body means. Relief means, such as slots, are provided in the female coupler means to allow for dimensional variations of the male couplers that are inherent in the blowmolding process and still provide interlocking with the male couplers. In addition, the relief means and flexible nature of the male coupler allow the blocks to be easily interconnected with each other and removed from each other by young children whose strength and/or manual dexterity have not yet fully developed.

27 Claims, 19 Drawing Figures

FIG. 1
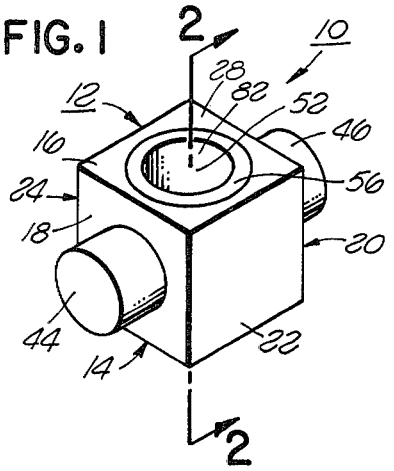
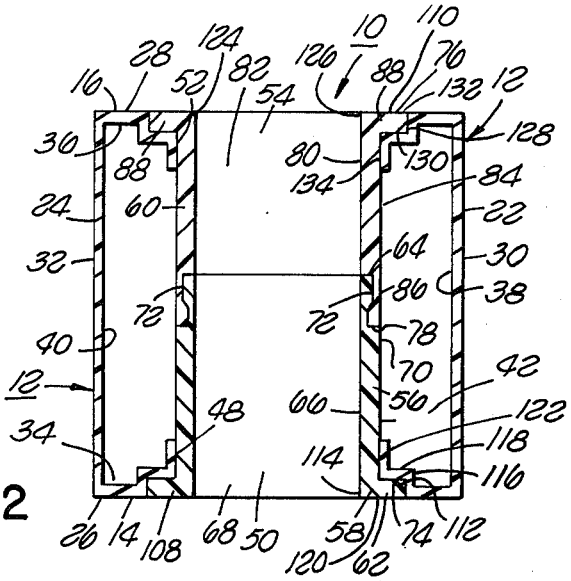
FIG. 2
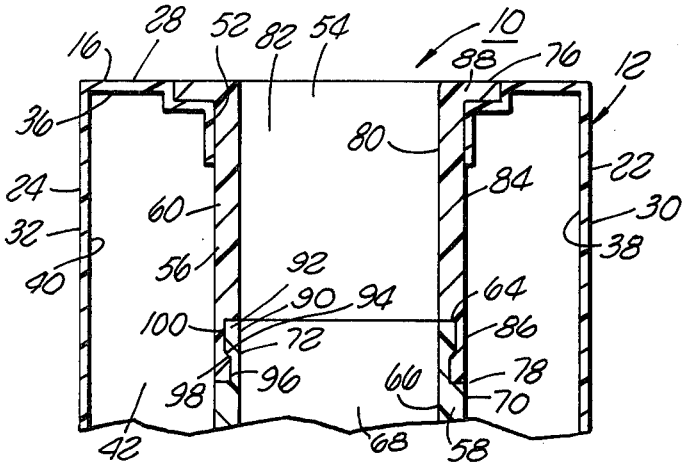
FIG. 3
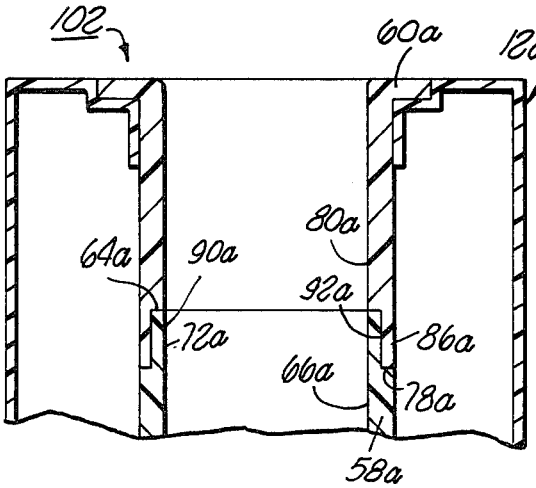
FIG. 4
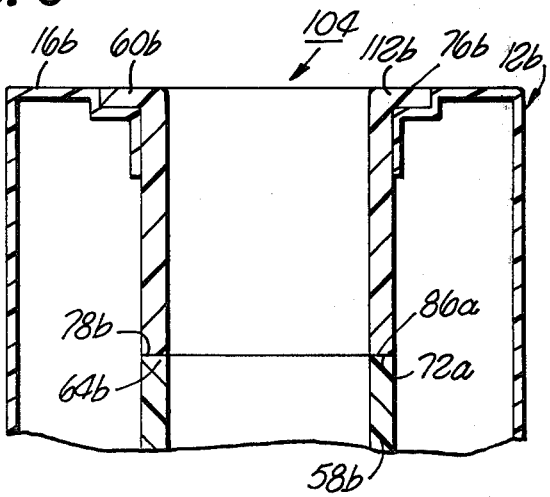
FIG. 5

INTERCONNECTING TOY BLOCK ARRANGEMENT

BACKGROUND OF THE INVENTION

1. Field of the Invention

This invention relates to toy blocks and, more particularly, to hollow blowmolded plastic blocks having interconnecting arrangements.

2. Description of the Prior Art

Toy blocks have long been fabricated from many different materials. Wood, ceramics, metals, and plastics have all been used. Various different interlocking or interconnecting arrangements have also been utilized to allow the blocks to be interconnected with each other and removed from each other. Such arrangements include tongues and grooves, notches of various types, pin arrangements, protrusions and protrusion accepting apertures having various configurations, and the like.

Toy blocks, in general, are designed for children to entertain, educate, and aid in the development of improved physical dexterity. Many of the above different interconnecting combinations are specifically designed to appeal to children having particular age and mental development levels. Difficult interconnecting combinations generally appeal to older and more educationally developed children. However, simpler interconnecting arrangements are required for younger children, since, in the case of younger children, it is very important to provide toys which challenge the child but do not frustrate the child to the point that the child rejects the toys. The small fingers, lack of physical strength, and limited manual dexterity of younger children impose constraints on the design and fabrication of interconnecting toy blocks. Such toy blocks for such younger children must, therefore, be comparatively easy to connect together and disconnect. Such ease of interconnection and removal enhances the play value of the blocks. Further, it is also required that such blocks, when interconnected, are able to withstand the rigors and stresses normally associated with the use of the blocks without inadvertent disconnection.

Additionally, the blocks should also be able to provide a level of complexity and sophistication sufficient to maintain the interest of older children, or even adults, in order to extend the play life and utility thereof. These conflicting requirements have not, heretofore, been achieved in interconnecting toy block arrangements.

The development of plastics has allowed the molding of toy blocks in many new and more complex shapes. Plastics have also lowered the costs of production of the blocks. The lowest cost method of manufacturing of suitable plastic items is blowmolding. Blowmolding is a technique wherein a tube of hot plastic is extruded, inserted in a mold, and inflated with a gas forcing the walls of the tube to conform to the contours of the mold. One advantage of blowmolded plastics is that softer plastics may be utilized than can be utilized in injection molding techniques, thus allowing the product, for example, to be much softer than a comparable injection molded product. Another advantage of blowmolded products is that they tend to deflect easily upon being subjected to force and, at the same time, they tend to return to their original shape. However, attempts at using blowmolded plastics for children's toy blocks have not proven to be satisfactory because of the relatively close tolerances required to allow the toy blocks to interlock with each other satisfactorily. In addition, the blowmolded plastic blocks tend to be too soft to avoid being deflected beyond the point from which they can regain their original shapes and/or inadvertently disconnected when subjected to the substantial forces which children impose on their toys during the normal play time activities therewith.

Thus, the above, often conflicting, desiderata have not heretofore been achieved and, in particular, have not been achieved in blowmolded interconnecting toy block arrangements.

SUMMARY OF THE INVENTION

Accordingly, it is a primary objective of the invention to provide an improved interconnecting toy block arrangement.

It is another object of the present invention to provide a comparatively inexpensively fabricated toy block arrangement.

It is another object of the invention to provide interconnecting toy blocks fabricated of comparatively soft materials in order to decrease the change of injury to small children.

It is another object of the present invention to provide a means for strengthening the internal structure of a hollow toy block such as a blowmolded interconnecting toy block, so that deformation thereof does not exceed the condition wherein the block will not return to its original configuration.

It is another object of the present invention to provide interconnecting toy blocks which may be comparatively easily connected together and disconnected by young children, yet resistant to inadvertent disconnection, and still provide a comparatively high level of inherent sophistication for older children and/or adults.

It is another object of the present invention to provide an interconnected toy block arrangement, which through its utilization, improves the manual dexterity of the user.

These, and other objects of the invention, are realized in a preferred embodiment as described in detail hereinafter.

In the preferred embodiment of the present invention, there is provided a unitarily fabricated, hollow, blowmolded plastic body means having a plurality of wall members. A pair of aligned apertures are provided in at least two opposed wall members. A female coupler means is positionable within the pair of aligned apertures and, in the preferred embodiment of the present invention, the female coupler means is fabricated, such as by injection molding, from a material, such as plastic, that is less flexible than the body means. The female coupler means extends through the hollow body means and is retained therein by engagement of the outer ends thereof with the wall members of the pair of aligned apertures. The comparatively rigid female coupler means thus provides structural support to the hollow body means. Preferably, the female coupler means is fabricated from a first and second female coupler members which are joined together inside the hollow body means. Each construction of the female coupler means allows provision of a collar on each outer end for engagement with the wall members of the body means. If desired, more than one pair of aligned apertures may be provided in the same opposed wall members of the body means or in other opposed wall members of the body means and female coupler means provided for retention in each such pair of aligned apertures.

One or more male couplers may also be provided on the body means. It will be appreciated that the interconnecting toy blocks of the present invention may be fabricated in different configurations to provide an enhanced play value and interest. However, each of the blocks is provided with at least one of the above described female coupler means and may, if desired, be provided with one or more male couplers.

The male couplers are unitarily fabricated with the body means during, for example, the blowmolding and extend outwardly from one of the wall members thereof. Thus, the male couplers are also hollow of the same degree of flexibility as the body means.

The male coupler of a first toy block is adapted to be detachably interconnected into a matching aperture in the female coupler means of a second toy block. In order to provide the desired ease of connection and removal of the male coupler means, in the preferred embodiment of the present invention, it has been found advantageous to provide one or more slots at the outer extremities of the female coupler means. Since the dimensional tolerances of the blowmolded male coupler may vary to a much greater extent than the injection molded female coupler means, the provision of the slots allows molding of the female coupler means to a slightly smaller dimension than the smallest anticipated male coupler. Upon insertion of the male coupler into the aperture of a female coupler means, the slots allow a resilient expansion of the female coupler means to provide the detachable interconnection between the toy blocks by the frictional engagement therebetween, regardless of the dimensional variations encountered in manufacturing the male coupler.

Further, according to the principles of the present invention, in some applications it has been found advantageous to provide a plurality of ridges in the apertures of the female coupler means for providing the frictional engagement with the male coupler. Such ridges allow a more precise control, as well as a reduction of the frictional forces between the male coupler and the female coupler means. Such structure is particularly advantageous in those applications where the toy blocks, and corresponding male couplers, are of a comparatively large size, though such structure may also be advantageously utilized in any size toy blocks of the present invention.

The wall members of the body means may be planar, singly curved and doubly curved, and the blocks may be fabricated in any desired geometrical configuration, including the conventional rectangular parallelepiped as well as other more unconventional shapes. Similarly, the male coupler, and matching aperture in the female coupler means may have any desired cross sectional geometry such as circular, rectangular, polygonal, square, or the like.

BRIEF DESCRIPTION OF THE DRAWING

The above and other embodiments of the present invention may be more fully understood from the following detailed description taken together with the accompanying drawing wherein similar reference characters refer to similar elements throughout and in which:

FIG. 1 is a perspective view of a preferred embodiment of an improved interconnecting toy block arrangement according to the principles of the present invention;

FIG. 2 is a sectional view of the embodiment of FIG. 1 taken along the line 2—2 of FIG. 1;

FIG. 3 is an enlarged view of a portion of the embodiment shown in FIGS. 1 and 2;

FIG. 4 is a sectional view similar to FIG. 3, of another embodiment of the present invention;

FIG. 5 is a sectional view similar to FIGS. 3 and 4 of another embodiment of the present invention;

DESCRIPTION OF THE PREFERRED EMBODIMENTS

Figure 6:
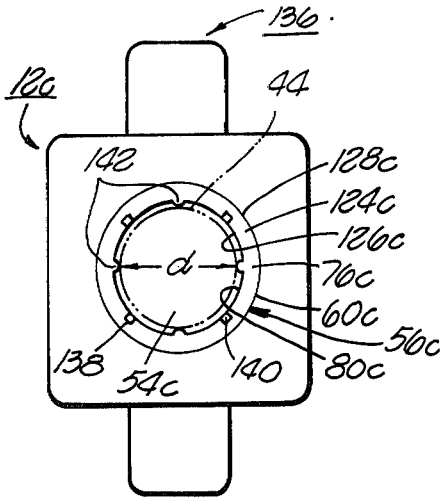
FIG. 6 is a plan view of another embodiment of the present invention showing the outer end of a female coupler means having internal ridges.

Referring now to the various Figures of the drawing, there is illustrated in FIGS. 1, 2, and 3 an embodiment, generally designated 10, of an improved interconnecting toy block arrangement of the present invention. In the embodiment 10 there is provided a body means 12 fabricated of a blowmolded semi-flexible plastic material having a first predetermined flexibility. Body member 12 is unitarily fabricated of a plurality of wall members—first wall 14, second wall 16, third wall 18, fourth wall 20, fifth wall 22, and sixth wall 24, and each of the walls 14, 16, 18, 20, 22, and 24 have external surfaces such as first wall external surface 26, second wall external surface 28, fifth wall external surface 30, and sixth wall external surface 32, and internal surfaces such as first wall internal surface 34, second wall internal surface 36, fifth wall internal surface 38, and sixth wall internal surface 40, said internal surfaces defining body cavity 42. First male coupler 44 is located on third wall 18 and second male coupler 46 is located on fourth wall 20. Both first male coupler 44 and second male coupler 46 have cylindrical configurations.

First wall 14 is also provided with first internal walls 48 defining a first aperture 50 therethrough and second wall 16 has second internal walls 52 defining a second aperture 54 therethrough aligned with said first aperture 50.

A first female coupler means 56 fabricated of injection molded plastic having a second predetermined flexibility less than the first predetermined flexibility of the body means 12 and is comprised of first female coupler member 58 and second female coupler member 60. First female coupler member 58 has an outer end 62, an inner end 64 spaced a first predetermined distance from said outer end 62 and positioned within said body cavity 42, internal wall surfaces 66 defining a male coupler receiving aperture 68 extending from the outer end 62 toward the inner end 64, external wall surfaces 70, interlocking means 72 on the inner end 64 for interlocking the first female coupler member 58 to the second female coupler member 60, and retention means 74 for retaining the outer end 62 of the first female coupler member 56 at the first wall 14. Second female coupler member 60 has an outer end 76, an inner end 78 spaced a first predetermined distance from said outer end 76 and positioned within said body cavity 42, internal wall surfaces 80 defining a male coupler receiving aperture 82 extending from the outer end 76 toward the inner end 78, external wall surfaces 84, interlocking means 86 on the inner end 78 for interlocking the second female coupler member 60 to the first female coupler member 58, and retention means 88 for retaining the outer end 76 of second female coupler member 60 at the second wall 16. Second female coupler member 60 is positioned in the second aperture 54 and first female coupler member 58 is positioned in the first aperture 50 of body member 12. As shown, first male coupler member 44 and first and second apertures 50 and 54 have cylindrical configurations. It will be appreciated that other geometric configurations may be used.

FIGS. 3, 4, and 5 illustrate various structural configurations of interlocking means 72 and 86. FIG. 3 is an enlargement of embodiment 10 shown in FIGS. 1 and 2. First female coupler member 58 has an insertion portion 90 and second female coupler member 60 has an insertion portion receiving aperture 92 defined by internal wall surfaces 80. Insertion portion 90 of first female coupler member 58 is positioned within insertion portion receiving aperture 92 of second female coupler member 60 and is frictionally retained therein. Insertion portion 90 has a first peripheral shoulder 94 and a first peripheral groove 96 on external wall surfaces 70 and insertion portion receiving aperture 92 has a second peripheral shoulder 98 and a second peripheral groove 100 on internal wall surfaces 80. First peripheral shoulder 94 is positioned in second peripheral groove 100 and second peripheral shoulder 98 is positioned in first peripheral groove 96 for interlocking retention therebetween first female coupler member 58 and second female coupler member 60, It will be appreciated that in addition to the frictional interlocking engagement provided by interlocking means 72 and interlocking means 86, first female coupler member 58 and second female coupler member 60 may be permanently coupled to each other by the addition of a bonding agent such a glue between interlocking means 72 and 86.

FIG. 4 is a sectional view of another embodiment 102 similar to the sectional view shown in FIG. 3 of embodiment 10. Interlocking means 72*a* of first female coupler member 58*a* has an insertion portion 90*a* on inner end 64*a*. Interlocking means 86*a* of second female coupler member 60*a* has an insertion portion receiving aperture 92*a* defined by internal wall surfaces 80*a*. Insertion portion 90*a* of first female coupler member 58*a* is positioned within insertion portion receiving aperture 92*a* of second female coupler member 60*a*. Insertion portion 90*a* and insertion portion receiving aperture 92*a* are fabricated in the manner shown in order to allow greater surface contact between inner end 64*a* and inner end 78*a* than would be possible with a butt fit. If desired, a bonding agent such as glue may be utilized to bond the two female coupler members 58*a* and 60*a* together. In addition, the configuration of embodiment 102 provides internal wall surfaces 66*a* of first female coupler member 58*a* and internal wall surfaces 80*a* of second female coupler member 60*a* in an aligned position.

FIG. 5 is a sectional view of another embodiment 104 of the present invention similar to embodiment 102 of FIG. 4 and embodiment 10 of FIG. 3. Inner end 64*b* of first female coupler member 58*b* abuts against inner end 78*b* of second female coupler member 60*b*. Interlocking therebetween is achieved by bonding or, if desired, by welding inner end 64*b* to inner end 78*b*. The welding may utilize ultrasonic sound generated by an ultrasonic welding apparatus (not shown) located adjacent inner ends 64*b* and 78*b* to excite the molecules of first female coupler member 58*b* and second female coupler member 60*b* at this location causing them to fuse together. Alternatively, the welding may be achieved by a spinning technique which spins second female coupler member 60*b* relative to first female coupler member 58*b* thereby generating heat in the inner ends 64*b* and 78*b* causing the molecules located therein to fuse with each other when the spinning ceases. It will be appreciated that other weling techniques may achieve the same effect and, as noted, that bonding agents such as glues may also be used to secure the female coupler members to each other when the inner ends simply abut against each other.

Returning now to FIG. 2, retention means 108 on outer end 62 of first female coupler member 58 retains outer end 62 at first wall 14 of body means 12. Likewise, retention means 110 on outer end 76 of second female coupler member 60 retains the outer end 76 at second wall 16. Retention means 108 has a collar 112 on outer end 62 of first female coupler member 58 with an inner edge 114 at internal wall surfaces 66 and an outer edge 116 spaced from external wall surfaces 70. Also, retention means 108 comprises a collar accepting indentation 118 in first wall 14 defined by first internal wall 48 such that the insertion of first female coupler member 58 into first aperture 50 provides outer surface 120 of collar 112 substantially flush with first wall external surface 26. The retention means 108 also comprises sleeve 122, also defined by first internal wall 48 of first wall 14, which extends into body cavity 42 to frictionally engage the external wall surfaces 70 of first female coupler member 58.

Likewise, retention means 110 has a collar 124 having an inner edge 126 at internal wall surfaces 80 and an outer edge 128 shaped from external wall surfaces 84. In addition, retention means 110 also comprises a collar accepting indentation 130 in second wall 16 defined by second internal walls 52 to allow collar outer surface 132 to be substantially flush with second wall external surface 28 when second female coupler member 60 is inserted through second aperture 54 into body cavity 42. Retention means 110 also comprises sleeve 134 defined by second internal walls 52 or second wall 16 and extends into body cavity 42 to frictionally engage external wall surfaces 84 of second female coupler member 60.

FIGS. 6, 7, 8, 9, and 10 illustrate another embodiment, generally designated 136, of the present invention. FIG. 6 is a plan view of embodiment 136 showing the outer end 76*c* of second female coupler member 60*c*. Embodiment 136 is similar to embodiment 10 of FIGS. 1, 2, and 3. Body means 12*c* is identical to body means 12. First female coupler means 56*c* of embodiment 136 is, however, different than first female coupler means 56 of embodiment 10. FIG. 6 illustrates two of the differences. Outer end 76*c* of second female coupler member 60*c* is shown having relief means 138 in the form of slots 140 extending from inner edge 126*c* of collar 124*c* towards outer edge 128*c*. The slots 140 increase the second predetermined flexibility of second female coupler member 60*c*. Thus, when a male coupler such as first male coupler 44 of FIG. 1 illustrated by the phantom circular line is inserted in second aperture 54*c*, the ease of insertion and removal are enhanced because the slots 140 will allow the diameter of second female coupler member 60*c* to expand more readily than another female coupler member not having the slots.

The second modification of first female coupler means 56*c* is the addition of internal ridges 142. Internal ridges 142 serve the purpose of satisfactorily frictionally engaging male couplers 44 having a greater range of diameters, d, than would a second female coupler member 60*c* not having internal ridges. Because of the blowmolding technique used to form first male couplers 44, the diameter, d, of male couplers 44 may vary significantly between different toy block arrangements. In order to frictionally engage as many different sizes of first male couplers 44 as possible, the diameter between internal ridges 142 is selected to be slightly smaller than the minimum diameter, d, found in male couplers 44 as determined by manufacturing experience. Internal diameter, d′, between internal wall surfaces 80*c* shown in FIG. 7 of second female coupler member 60*c* is preferably made larger than any diameter, d, of a first male coupler 44. Thus, second female coupler member 60*c* having internal ridges 142 is capable of frictionally engaging a large range of various diameter first male couplers 44. For those first made couplers 44 having diameters larger than diameter, d, internal ridges 142 may indent into first male couplers 44 at the four points where they exist on internal wall surfaces 80*c*. Because the blowmolded plastic is a relatively soft material, this indentation of first male couplers 44 is easily achieved. If, however, the internal ridges 142 were not present, diameter, d′, would have to expand by virtue of relief means 138 to match the diameter, d, of first male couplers 44. If neither internal ridges 142 or relief means 138 are present, first male couplers 44 must be compressed. The force and dexterity required to achieve this expansion and/or compression is much greater than the force required to indent the first male couplers 44 along only the four points of internal ridges 142.

In those embodiments wherein the internal ridges 142 are combined in a female coupler member with the relief means 138, an even wider range of variations in male coupler diameters may be accommodated due to the added resilient expansion of the female coupler in addition to compression of the male coupler.

Since the ridges 142 have less surface area contact with an inserted male coupler, the frictional force therebetween is less than the embodiments wherein no internal ridges are provided and less force and a lower level of strength and/or manual dexterity is required for interconnection and removal of one block from another.

It will be appreciated that these objectives are achieved without sacrifice of play interest or sophistication level of the toy block arrangement, and is achieved in various degrees by provision of either or both the internal ridges 142 and relief means 138 in the female coupler members. Thus, according to the principles of the present invention, the frictional force required during the interconnection and removal of one block from another is much more precisely controllable than heretofore in prior toy block arrangements.

Figure 7:
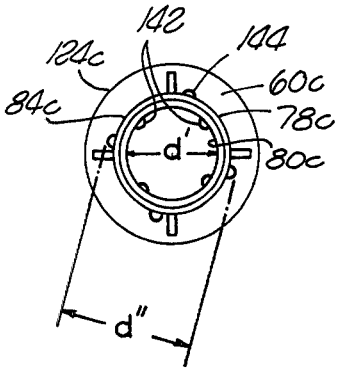
FIG. 7 is a plan view of the inner end of the female coupler means shown in FIG. 6.

FIG. 7 is a plan view of second female coupler member 60*c* viewed from inner end 78*c*. FIG. 7 illustrates the third change from embodiment 10 shown in FIGS. 1, 2, and 3. External ridges 144 on external wall surfaces 84*c* provide the same function in relation to sleeves 134*c* (FIG. 8) as do internal ridges 142 in relation to first male couplers 44, as described above. Because sleeves 134*c* are fabricated of blowmolded plastic, the diameters thereof vary over a large range in much the same manner as do the diameters of first male couplers 44. Diameter d″ is selected to correspond to a value slightly smaller than the maximum diameter of the sleeves 134*c* as determined by manufacturing experience. External ridges 144 thereby aid in retaining second female coupler member 60*c* within sleeve 134*c*, regardless of dimensional variations encountered. Thus, female coupler member 60*c* is retained within sleeve 134*c* by the frictional engagement of ridges 144 with sleeve 134*c*. The ridges 144 thereby allow both easier assembly of a toy block as well as greater manufacturing efficiency and less cost since the dimensions of the various elements need not be as precisely held and a greater variation in dimension is permissible.

Figure 8:
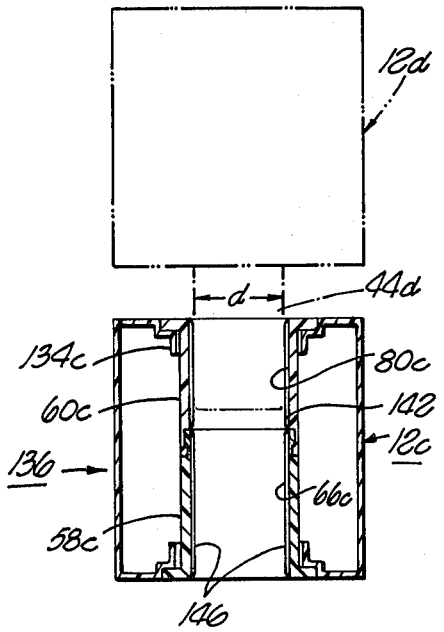
FIG. 8 is a sectional view of the embodiment of FIG. 6 illustrating the detachable interconnection between two toy blocks of the present invention.

FIG. 8 is a sectional view of embodiment 136 which is similar to embodiment 10 of FIG. 2 except that embodiment 136 has internal ridges 142 on internal wall surfaces 80*c* of second female coupler member 60*c* and internal ridges 146 on internal wall surfaces 66*c* of first female coupler member 58*c*. A second body means 12*d* with first male coupler 44*d* is shown above body means 12*c* and with first male coupler 44*d* inserted into second female coupler member 60*c* in order to show the relationship between first male coupler 44*d* and internal ridges 142 and internal wall surfaces 80*c* of second female coupler member 60*c*. Body means 12*d* is thus frictionally retained in the position shown in relation to body means 12*c*.

Figure 9:
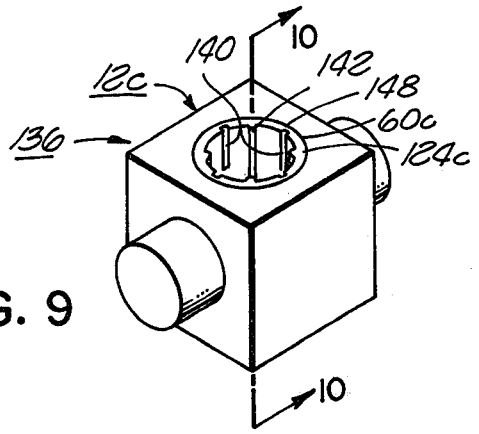
FIG. 9 is a perspective view of the embodiment of the present invention shown in FIG. 6.

FIG. 9 is a perspective view of embodiment 136 positioned to show the nature and extent of internal ridges 142 and slots 140.

Figure 10:
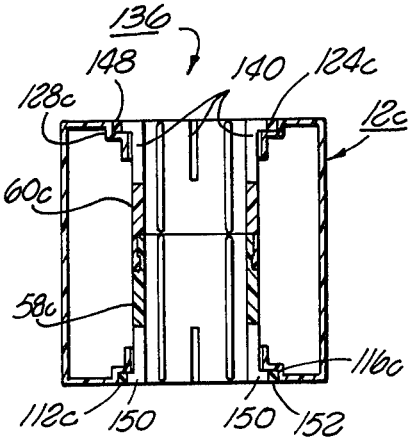
FIG. 10 is a sectional view of the embodiment shown in FIG. 9 taken along the line 10—10.

FIG. 10 is a sectional view of embodiment 136 along line 10—10 of FIG. 9. Section line 10—10 is directly through the middle of two of the slots 140. Slots 140 do not extend all the way through collar 124*c* of second female coupler member 60*c* as can be seen at 148. Identical slots 150 are located in the first female coupler member 58*c*. Again slots 150 do not extend all the way through collar 112*c* as is shown at 152.

Figure 11:
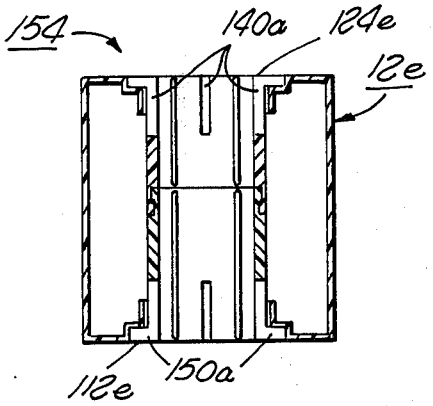
FIG. 11 is a sectional view similar to FIG. 10, of another embodiment of the present invention.

FIG. 11 is a sectional view of another embodiment, generally designated 154, of the present invention which has slots 140*a* and 150*a* which do extend all the way through collars 112*e* and 124*e*, respectively. Collars 112*e* and 124*e* thus expand more readily than collars 112*c* and 124*c*.

FIGS. 12, 13, 14, 15, 16, 17, 18, and 19 illustrate other embodiments of the present invention. In each of the embodiments there is provided at least one female coupler means. Each of the female coupler means may be any of the various structural configurations of female coupler means described above.

Figure 12:
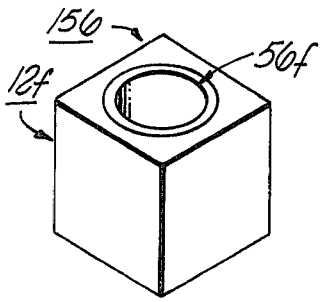
FIG. 12 is a perspective view of an embodiment of the present invention having one female coupler means and no male coupler means.

FIG. 12 is a perspective view of another embodiment, generally designated 156, of the present invention. Body means 12*f* has first female coupler means 56*f* and no male couplers.

Figure 13:
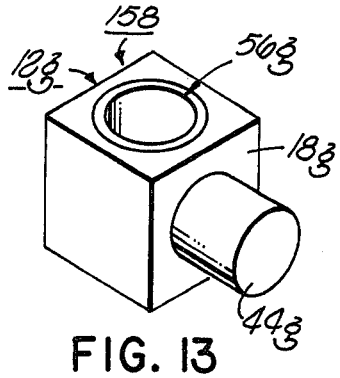
FIG. 13 is a perspective view of another embodiment of the present invention having one female coupler means and one male coupler.

FIG. 13 is a perspective view of another embodiment, generally designated 158, of the present invention. Body means 12*g* has first female coupler means 56*g* and third wall 18*g* has a first male coupler 44*g* extending outwardly therefrom.

Figure 14:
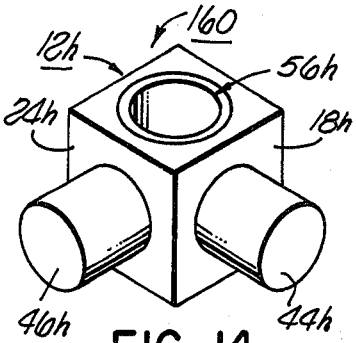
FIG. 14 is a perspective view of another embodiment of the present invention having one female coupler means and two male couplers which are perpendicular to each other.

FIG. 14 is a perspective view of another embodiment, generally designated 160, of the present invention. Body means 12*h* has first female coupler means 56*h*, third wall 18*h* having first male coupler 44*h*, and sixth wall 24*h* having second male coupler 46*h*. First male coupler 44*h* and second male coupler 46*h* are perpendicular to each other in embodiment 160.

Figure 15:
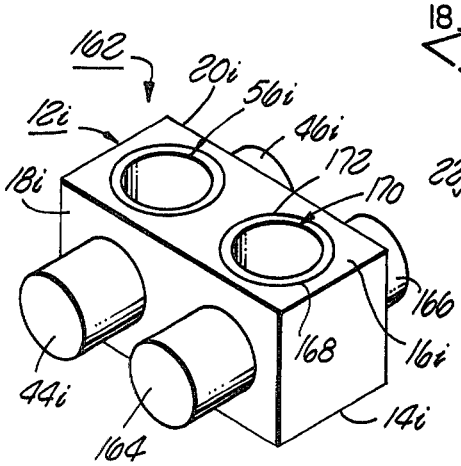
FIG. 15 is a perspective view of another embodiment of the present invention having two female coupler means and four male couplers.

FIG. 15 is another embodiment, generally designated 162, of the present invention. Body means 12*i* has third wall 18*i* having first male coupler 44*i* and third male coupler 164, fourth wall 20*i* having second male coupler 46*i* and fourth male coupler 166, first male coupler 44*i* and second male coupler 46*i* being in alignment with each other and third male coupler 164 and fourth male coupler 166 being in alignment with each other, second wall 16*i* having fourth internal walls (not shown) defining a fourth aperture 168 in the second wall 16*i*, first wall 14*i* (not shown) having third internal walls (not shown) defining a third aperture (not shown) in the first wall, a first female coupler means 56*i*, and a second female coupler means 170 located in the fourth aperture 168 and the third aperture. Fourth aperture 168 and the third aperture are in alignment with each other. First male coupler 44*i*, second male coupler 46*i*, third male coupler 164, and fourth male coupler 166 are substantially identical to each other. First female coupler means 56*i* and second female coupler means 170 are substantially identical to each other. Second female coupler means 170 has third female coupler member (not shown) and fourth female coupler member 172. The third female coupler member is positioned in the third aperture and the fourth female coupler member 172 is positioned in fourth aperture 168.

Figure 16:
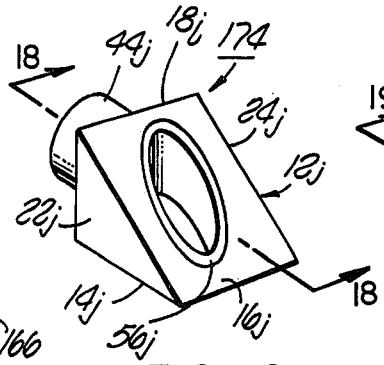
FIG. 16 is a perspective view of another embodiment of the present invention having five planar surfaces, one female coupler means, and one male coupler.

FIG. 16 is a perspective view of another embodiment, generally designated 174, of the present invention. Body means 12*j* has a first female coupler means 56*j* and a first male coupler 44*j*. All of the previous embodiments, including 10, 102, 104, 136, 154, 156, 158, 160, and 162, have had planar walls which are either parallel or perpendicular to each other. These embodiments have also had six walls. Embodiment 174 has planar walls but there are only five: first wall 14*j*, second wall 16*j*, third wall 18*j*, fifth wall 22*j*, and sixth wall 24*j*. Fifth wall 22*j* and sixth wall 24*j* thus become triangular in shape instead of square or rectangular as in the above embodiments.

Figure 17:
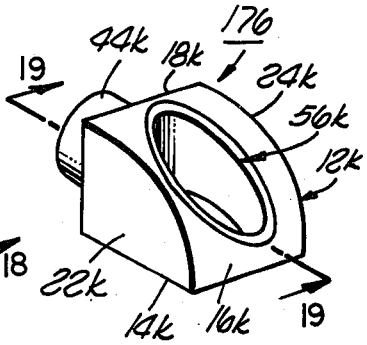
FIG. 17 is a perspective view of another embodiment of the present invention having a singly curved wall member, one female coupler means and one male coupler.

FIG. 17 is a perspective view of another embodiment, generally designated 176, of the present invention. Body means 12*k* has a first female coupler means 56*k* and a first male coupler 44*k*. Embodiment 176 is unlike any of the above embodiments because it has a second wall 16*k* which is curved. Each of the other walls is planar: first wall 14*k*, third wall 18*k*, fifth wall 22*k*, and sixth wall 24*k*.

Figure 18:
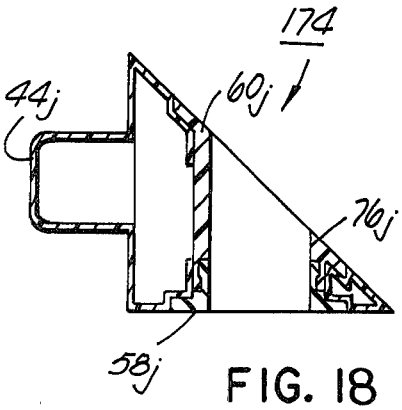
FIG. 18 is a sectional view of FIG. 16 taken along the line 18—18.

FIG. 18 is a sectional view of embodiment 174 along line 18—18 of FIG. 16. First female coupler member 58*j* has a smaller axial length than first female coupler member 58 of FIG. 2. Second female coupler member 68*j* differs from second female coupler member 60 of FIG. 2 in that the plane of outer end 76*j* is not perpendicular to the axis of second female coupler member 60*j*.

Figure 19:
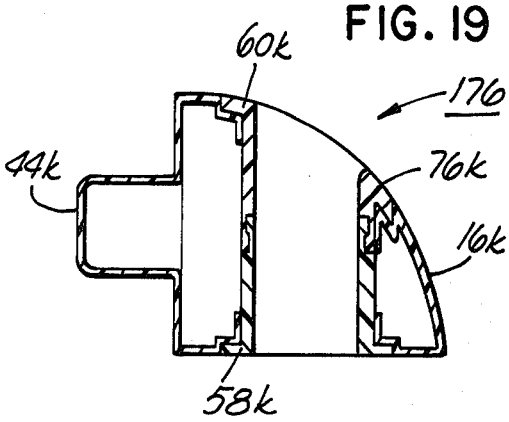
FIG. 19 is a sectional view of the embodiment shown in FIG. 17 taken along the line 19—19.

FIG. 19 is a sectional view of embodiment 176 along the line 19—19 of FIG. 17. First female coupler member 58*k* has a smaller axial length than first female coupler member 58 of FIG. 2. The outer end 76*k* of female coupler member 60*k* is curved to conform to the curvature of second wall 16*k*.

It will be appreciated that the male couplers and male coupler receiving apertures may have other geometric configurations including arcuate or those having rectangular, polygonal, or square cross sections.

This concludes the description of the preferred embodiments of the present invention. Those skilled in the art may find many variations and adaptations thereof and the attached claims are intended to cover all such variations and adaptations falling within the true scope and spirit of the invention.

We claim:

1. An improved interconnecting toy block arrangement comprising in combination:

a semi-flexible body means having a first predetermined flexibility and having a plurality of wall members unitarily fabricated defining a body cavity;

a first wall of said plurality of wall members having first internal walls defining a first aperture therethrough, and a second wall of said plurality of wall members having second internal walls defining a second aperture therethrough aligned with said first aperture.

a semi rigid first female coupler means discrete from said semi-rigid body means having a second predetermined flexibility less than said first predetermined flexibility and comprising a first female coupler member and a second female coupler member and each of said first and second female coupler members having:

an outer end;

an inner end spaced a first predetermined distance from said outer end and positionable within said body cavity;

internal wall surfaces defining a male coupler receiving aperture extending from said outer end toward said inner end thereof;

external wall surfaces;

a collar on said outer end having an inner edge at said internal wall surfaces and an outer edge spaced from said external wall surfaces;

a plurality of internal ridges on said internal wall surfaces extending from said outer end toward said inner end and a plurality of external ridges on said external wall surfaces extending from said outer end toward said inner end;

relief means in regions adjacent said outer end for contributing to the flexibility of said female coupler member adjacent said outer end thereof having walls defining a plurality of slots extending from said internal wall surfaces to said external wall surfaces and extending into said collar from said inner edge toward said outer edge; and said inner end having an interlocking means comprising one of an insertion portion and walls defining an insertion portion receiving aperture;

said inner end of said first female coupler member having said insertion portion and said inner end of said second female coupler member having said walls defining said insertion portion receiving aperture, and said insertion portion of said first female coupler member positioned within said insertion portion receiving aperture of said second female coupler member for interlocking said first female coupler member to said second female coupler member; and retention means for retaining said collar of said first female coupler member at said first wall of said plurality of wall members and said collar of said second female coupler member at said second wall of said plurality of wall members.

2. The arrangement defined in claim 1 wherein said insertion portion of said first female coupler member is frictionally retainable in said insertion portion receiving aperture of said second said female coupler member.

3. The arrangement defined in claim 1, wherein said insertion portion further comprises a first peripheral shoulder and a first peripheral groove on said external wall surfaces of said first female coupler member, and said insertion portion receiving aperture further comprises a second peripheral shoulder and a second peripheral groove on said internal wall surfaces of said second female coupler member, and said first peripheral shoulder is positionable in said second peripheral groove and said second peripheral shoulder is positionable in said first peripheral groove for interlocking retention therebetween.

4. The arrangement defined in claim 1 wherein said insertion portion of said first female coupler member is bondable to said insertion portion receiving aperture of said second female coupler member.

5. The arrangement defined in claim 1 wherein said interlocking means on said inner ends is a welding of said inner ends to each other.

6. The arrangement defined in claim 1 wherein said first and second walls of said body means each have a collar accepting indentation to provide each of said collars substantially flush with said outer surfaces of said first and second walls of said body means.

7. The arrangement defined in claim 1 wherein said retention means further comprises a sleeve on each of said first and second walls of said body means at said first and second apertures extending into said body cavity for frictionally engaging said first and second female coupler members.

8. The arrangement defined in claim 7 wherein said plurality of external ridges on said external wall surfaces frictionally engage said sleeve.

9. The arrangement defined in claim 1 and further comprising:

a collar accepting indentation on each of said first and second walls of said body means to provide each of said collars substantially flush with said outer surfaces of said first and second walls of said body means;

a sleeve on each of said first and second walls of said body means at said first and second apertures extending into said body cavity for frictionally engaging said first and second female coupller members; and said plurality of external ridges frictionally engage said sleeve.

10. The arrangement defined in claim 1 wherein said internal wall surfaces defining said male coupler receiving aperture have an arcuate configuration.

11. The arrangement defined in claim 10 wherein said arcuate configuration is cylindrical.

12. The arrangement defined in claim 1 wherein said internal wall surfaces defining said male coupler receiving aperture have a polygonal cross sectional geometry.

13. The arrangement defined in claim 12 wherein said polygonal cross sectional geometry is a square.

14. The arrangement defined in claim 1 wherein each of said first and second female coupler members further comprises said slots extending through said collar from said inner edge to said outer edge.

15. The arrangement defined in claim 1 and further comprising a third wall of said plurality of wall members having a first male coupler extending outwardly therefrom for detachable coupling with a female coupler means of another toy block.

16. The arrangement defined in claim 15 and further comprising a fourth wall of said plurality of wall members having a second male coupler substantially identical to said first male coupler.

17. The arrangement defined in claim 16 wherein said first and second male couplers are in alignment with each other.

18. The arrangement defined in claim 17 wherein said first and second male couplers are perpendicular to each other.

19. The arrangement defined in claim 17 and further comprising a third male coupler substantially identical to said first male coupler on said third wall, a fourth male coupler substantially identical to said first male coupler on said fourth wall, said third male coupler and said fourth male coupler in alignment with each other, and third internal walls defining a third aperture in said first wall, fourth internal walls defining a fourth aperture in said second wall, and said third aperture and said fourth aperture in alignment with each other, and a second female coupler means substantially identical to said first female coupler means comprising a third female coupler member and a fourth female coupler member and said third female coupler member positioned in said third aperture and said fourth female coupler member positioned in said fourth aperture.

20. The arrangement defined in claim 1 wherein each of said plurality of wall members of said body means is substantially planar.

21. The arrangement defined in claim 15 wherein said second wall is curved and each of the other of said plurality of wall members is planar.

22. The arrangement defined in claim 15 wherein said plurality of wall members comprises five wall members and each of said plurality of wall members is planar.

23. The arrangement defined in claim 1 wherein said body means is fabricated of blow molded plastic.

24. The arrangement defined in claim 23 wherein said female coupler means is fabricated of injection molded plastic.

25. The arrangement defined in claim 3 and further comprising:

said retention means having:

a collar accepting indentation on each of said first and second walls of said body means to provide each of said collars substantially flush with said outer surfaces of said first and second walls of said body means; and a sleeve on each of said first and second walls on said body means at said first and second apertures extending into said body cavity for frictionally engaging said first and second female coupler members; and said internal wall surfaces defining said male coupler receiving aperture have a cylindrical configuration.

26. A first female coupler means comprising, in combination:

a first female coupler member;

a second female coupler member;

each of said first and second female coupler members having:

an outer end;

an inner end spaced a first predetermined distance from said outer end;

internal wall surfaces defining a male coupler receiving aperture extending from said outer end toward said inner end thereof;

external wall surfaces;

a collar on said outer end having an inner edge at said internal wall surfaces and an outer edge spaced from said external wall surfaces;

a plurality of internal ridges on said internal wall surfaces extending from said outer end toward said inner end and a plurality of external ridges on said external wall surfaces extending from said outer end toward said inner end;

relief means in regions adjacent said outer end for contributing to the flexibility of said female coupler member adjacent said outer end thereof having walls defining a plurality of slots extending from said internal wall surfaces to said external wall surfaces and extending into said collar from said inner edge toward said outer edge; and said inner end having an interlocking means comprising one of an insertion portion and walls defining an insertion portion receiving aperture; and said inner end of said first female coupler member having said insertion portion and said inner end of said second female coupler member having said walls defining said insertion portion receiving aperture, and said insertion portion of said first female coupler member positioned within said insertion portion receiving aperture of said second female coupler member for interlocking said first female coupler member to said second female coupler member.

27. The arrangement defined in claim 26, wherein said insertion portion further comprises a first peripheral shoulder and a first peripheral groove on said exterior wall surfaces of said first female coupler member, and said insertion portion receiving aperture further comprises a second peripheral shoulder and a second peripheral groove on said inner wall surfaces of said second female coupler member, and said first peripheral shoulder is positionable in said second peripheral groove and said second peripheral shoulder is positionable in said first peripheral groove for interlocking retention therebetween.

* * * * *